US009605534B2

(12) United States Patent
Chen et al.

(10) Patent No.: US 9,605,534 B2
(45) Date of Patent: Mar. 28, 2017

(54) REAL-TIME FLOW INJECTION MONITORING USING DISTRIBUTED BRAGG GRATING

(71) Applicants: Jeff Chen, Pearland, TX (US); Luis E. Mendez, Houston, TX (US); Chee M. Chok, Houston, TX (US); Xudong Yang, Katy, TX (US)

(72) Inventors: Jeff Chen, Pearland, TX (US); Luis E. Mendez, Houston, TX (US); Chee M. Chok, Houston, TX (US); Xudong Yang, Katy, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 628 days.

(21) Appl. No.: 14/079,275

(22) Filed: Nov. 13, 2013

(65) Prior Publication Data

US 2015/0128692 A1 May 14, 2015

(51) Int. Cl.
*E21B 47/10* (2012.01)
*E21B 47/12* (2012.01)

(52) U.S. Cl.
CPC ..... *E21B 47/1005* (2013.01); *E21B 47/123* (2013.01)

(58) Field of Classification Search
USPC ..... 374/136, 137, 161, E11.016, E11.001; 73/23, 204.11
See application file for complete search history.

(56) References Cited

U.S. PATENT DOCUMENTS

| | | | |
|---|---|---|---|
| 4,030,064 | A | 6/1977 | Elliott |
| 4,859,844 | A | 8/1989 | Herman et al. |
| 5,401,956 | A | 3/1995 | Dunphy et al. |
| 5,625,724 | A | 4/1997 | Frederick et al. |
| 5,675,674 | A | 10/1997 | Weis |
| 5,963,321 | A | 10/1999 | Wang |

(Continued)

FOREIGN PATENT DOCUMENTS

| | | | |
|---|---|---|---|
| DE | 1991311 | A1 | 10/2000 |
| EP | 0892244 | A2 | 1/1999 |

(Continued)

OTHER PUBLICATIONS

Barak, Phillip; "Smoothing and Differentiation by an Adaptive-Degree Polynomial Filter," Analytical Chemistry, vol. 67, No. 17, Sep. 1, 1995, pp. 2758-2762.

(Continued)

*Primary Examiner* — Lisa Caputo
*Assistant Examiner* — Nasir U Ahmed
(74) *Attorney, Agent, or Firm* — Cantor Colburn LLP

(57) ABSTRACT

A system, method and computer-readable medium for monitoring a fluid injection at a downhole location in a wellbore is disclosed. A member is provided in the wellbore. The member includes a passage for flow of fluid and a fiber optic cable including a plurality of temperature sensitive sensors wrapped around the member. A selected temperature signal is imparted into the fluid flowing in the member. A temperature of the fluid exiting the member at the downhole location is measured using the plurality of temperature sensors. The measured temperature and the imparted temperature signal are compared to determine a flow parameter of the injected fluid.

20 Claims, 4 Drawing Sheets

(56) References Cited

U.S. PATENT DOCUMENTS

| | | | | |
|---|---|---|---|---|
| 6,016,702 | A | 1/2000 | Maron | |
| 6,069,686 | A | 5/2000 | Wang et al. | |
| 6,233,746 | B1 | 5/2001 | Skinner | |
| 6,252,656 | B1 | 6/2001 | Wu et al. | |
| 6,256,090 | B1 | 7/2001 | Chen et al. | |
| 6,346,702 | B1 | 2/2002 | Davis et al. | |
| 6,370,406 | B1 | 4/2002 | Wach et al. | |
| 6,487,349 | B2 | 11/2002 | Wach et al. | |
| 6,501,067 | B2 | 12/2002 | Jones et al. | |
| 6,611,633 | B1 | 8/2003 | Vohra et al. | |
| 6,753,791 | B2 | 6/2004 | Wei et al. | |
| 7,028,543 | B2 | 4/2006 | Hardage et al. | |
| 7,245,791 | B2 | 7/2007 | Rambow et al. | |
| 7,327,907 | B2 | 2/2008 | Shaibani et al. | |
| 7,424,186 | B2 | 9/2008 | Arab-Sadeghabadi et al. | |
| 8,506,625 | B2 * | 8/2013 | Johnson | A61F 2/2409 623/2.38 |
| 8,630,816 | B2 * | 1/2014 | Park | G01F 23/22 166/250.01 |
| 8,875,558 | B2 * | 11/2014 | Bosselmann | G01F 1/6884 73/23.31 |
| 2002/0075114 | A1 | 6/2002 | Hall et al. | |
| 2003/0122535 | A1 * | 7/2003 | Williams | E21B 43/2401 324/107 |
| 2006/0120675 | A1 | 6/2006 | Goldner et al. | |
| 2007/0126594 | A1 | 6/2007 | Atkinson et al. | |
| 2007/0251326 | A1 | 11/2007 | Mathis | |
| 2007/0289741 | A1 * | 12/2007 | Rambow | E21B 47/0006 166/250.01 |
| 2008/0047662 | A1 | 2/2008 | Dria et al. | |
| 2008/0068586 | A1 * | 3/2008 | Kishida | G01B 11/18 356/32 |
| 2008/0236836 | A1 * | 10/2008 | Weng | E21B 43/26 166/336 |
| 2009/0097015 | A1 | 4/2009 | Davies et al. | |

FOREIGN PATENT DOCUMENTS

| | | | |
|---|---|---|---|
| GB | 2368921 | A | 5/2002 |
| GB | 2397885 | A | 8/2004 |
| GB | 2411956 | A | 9/2005 |
| GB | 2433112 | A | 6/2007 |
| JP | 2003294851 | A | 10/2003 |
| WO | 03050376 | A2 | 6/2003 |
| WO | 2006113327 | A1 | 10/2006 |

OTHER PUBLICATIONS

Browne, M. et al.; "A multiscale polynomial filter for adaptive smoothing," Digital Signal Processing 17 (2007), www.sciencedirect.com; pp. 69-75.

Hayes, Monson H.; "9.4 Recursive Least Squares,"Statistical Digital Signal Processing and Modeling, 1996, pp. 541-553.

Savitzky, A. et al.; "Smoothing and Differentiation of Data by Simplified Least Squares Procedures," Analytical Chemistry, vol. 36, No. 8, Jul. 1964, pp. 1627-1639.

* cited by examiner

REAL-TIME FLOW INJECTION MONITORING USING DISTRIBUTED BRAGG GRATING

BACKGROUND OF THE DISCLOSURE

1. Field of the Disclosure

The present application is related to a system and method for monitoring flow injection in downhole formations and, in particular, for determining a flow profile for a fluid injected into a formation using a temperature signature imparted to the fluid.

2. Description of the Related Art

Fluid injection may be used in many aspects of petroleum engineering and exploration, including acid stimulation, formation fracturing, formation pressurization, etc. Fluid is generally injected into the formation from a surface location via a tubular extending through a borehole formed in a formation. The fluid travels down the tubular and exits the tubular at a downhole location through a screen or other porous material. While the flow of the fluid from the tubular is designed to be two-dimensionally isotropic, often fluid will flow more easily in one direction than in another direction. Understanding the actual flow profile of the injected fluid may be used to understand formation lithology and/or to make adjustments to the injection process.

SUMMARY OF THE DISCLOSURE

In one aspect, the present disclosure provides a method of monitoring a fluid injection at a downhole location in a wellbore, the method including: providing a member in the wellbore, the member including a passage for flow of fluid and a fiber optic cable including a plurality of temperature sensors wrapped around the member; imparting a selected temperature signal into the fluid flowing in the member; measuring a temperature of the fluid exiting the member at the downhole location using the plurality of temperature sensors; and comparing the measured temperature to the imparted temperature signal to determine a flow parameter of the injected fluid.

In another aspect, the present disclosure provides a system for monitoring a fluid injection in a wellbore, the system including: a member in the wellbore configured to provide a flow path for the fluid from a surface location to an injection location in the wellbore; a heating element configured to impart a temperature signal into the fluid flowing in the member; a fiber optic cable including a plurality of spaced-apart temperature sensors wrapped around the member to obtain temperature measurements of the injected fluid exiting the member at a downhole location; and a processor configured to compare the imparted temperature signal and downhole temperature measurements to determine a flow parameter of the injected fluid.

In yet another aspect, the present disclosure provides a non-transitory computer-readable medium having a set of instructions stored therein that when accessed by a processor enables the processor to perform a method of monitoring a fluid injection at a downhole location, the method including: imparting a selected temperature signal into the fluid flowing in a member in the wellbore from a surface location to a downhole injection location; measuring a temperature of the fluid exiting the member at the downhole location using a plurality of temperature sensors wrapped around the member at the downhole injection location; and comparing the measured temperature to the imparted temperature signal to determine a flow parameter of the injected fluid.

Examples of certain features of the apparatus and method disclosed herein are summarized rather broadly in order that the detailed description thereof that follows may be better understood. There are, of course, additional features of the apparatus and method disclosed hereinafter that will form the subject of the claims.

BRIEF DESCRIPTION OF THE DRAWINGS

The present disclosure is best understood with reference to the accompanying figures in which like numerals refer to like elements and in which.

DETAILED DESCRIPTION OF THE DISCLOSURE

Figure 1:
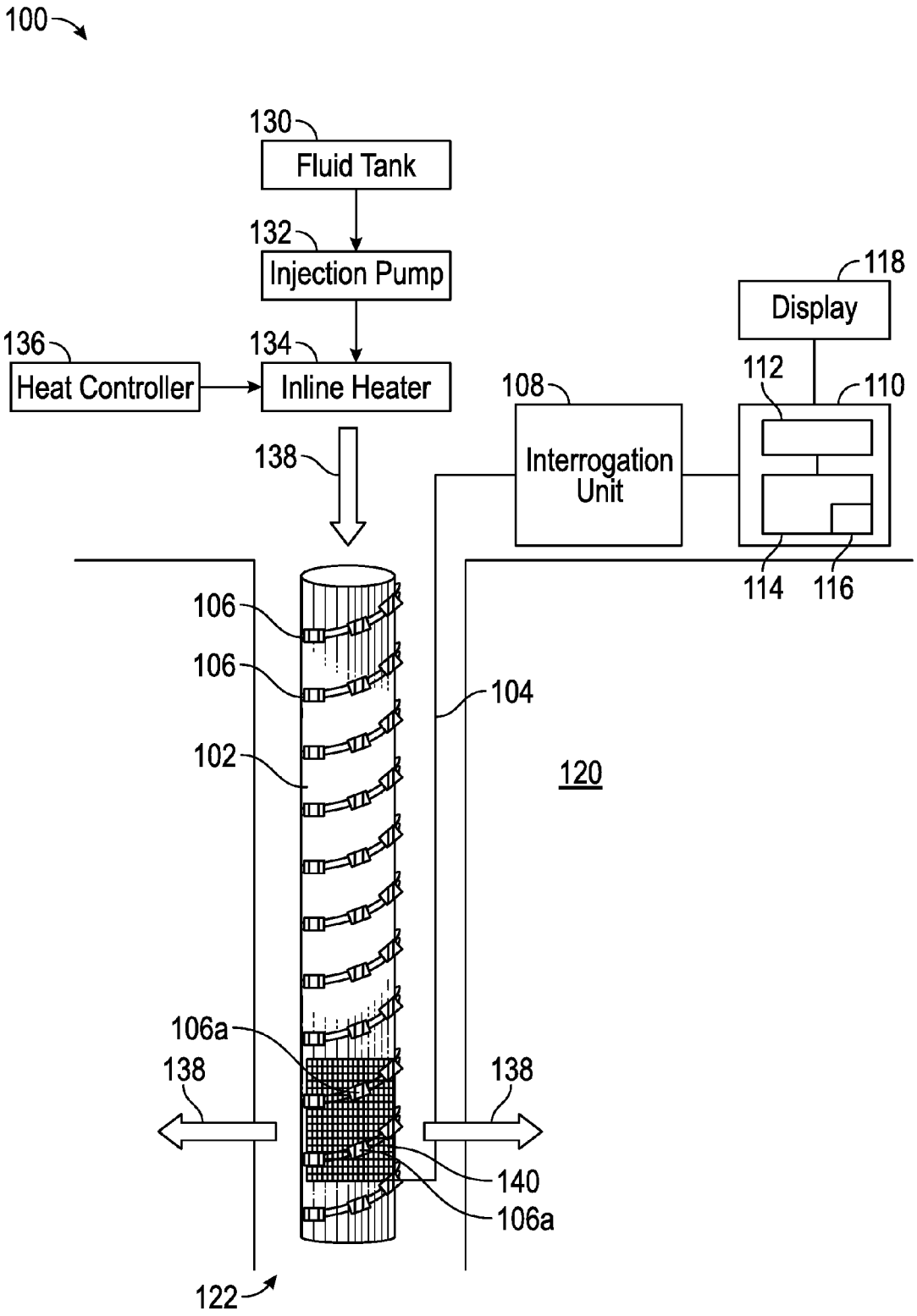
FIG. 1 shows an exemplary embodiment of a system for determining a injection profile of a fluid injected into a formation.

FIG. 1 shows an exemplary embodiment of a system 100 for determining an injection profile of a fluid injected into a formation 120. The system 100 includes a tubular 102 disposed in a borehole 122 formed in the formation 120. In an exemplary embodiment, the tubular 102 is an injection tubular. However, the tubular 102 may be any tubular suitable for injecting a fluid into the formation 120. In various embodiments, the tubular 102 may include a casing, a sand screen, a subsea riser, an umbilical, a production tubing, a coil tubing, a pipeline, or any other cylindrical structure bearing a load, and so forth.

A Real-Time Compaction Monitoring (RTCM) system is disposed on the tubular 102 in order to obtain discrete distributed strain measurements at the tubular 102. The RTCM system may include an optical strain sensing fiber 104 wrapped around the tubular 102. The optical fiber 104 may include a plurality of sensors 106 and may be wrapped around the tubular 102 so that the plurality of sensors 106 forms a helical array of sensors around the tubular 102. The sensors 106 are spatially distributed along the optical fiber 104 at a typical separation distance of a few centimeters. The sensors 106 therefore substantially cover a circumference and longitudinal extent of the tubular 102, and signals from the sensors 106 may be used to determine a two-dimensional strain distribution on a surface of the tubular 102. In various embodiments, the plurality of sensors 106 may be Fiber Bragg grating sensors, Brillouin fiber optic sensors, electrical strain sensors, etc. In an exemplary embodiment, the sensors 106 are Fiber Bragg grating sensors (FBGs) and are configured to obtain a strain measurement using the methods described below with respect to FIG. 2A-2C. While various actions may produce a strain at the sensors 106, for the purposes of this disclosure, the strain measurement are related to a change in temperature at the sensors 106.

Figure 2A:
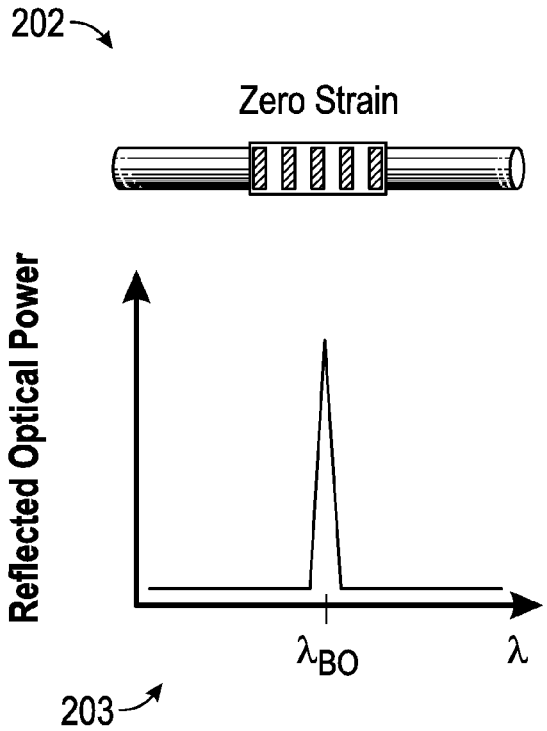
FIG. 2A-2C illustrate operation of an exemplary Fiber Bragg Grating that may be used as a sensor on an exemplary tubular of the system of FIG. 1.
Figure 2B:
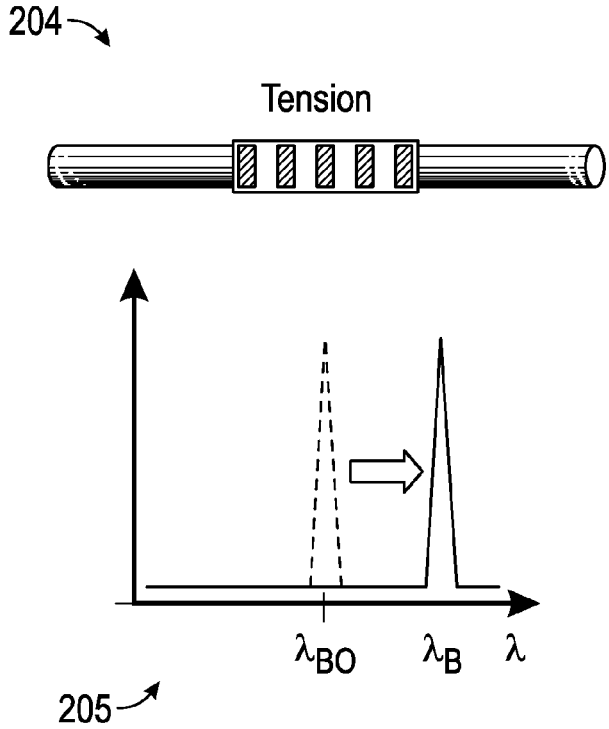
Figure 2C:
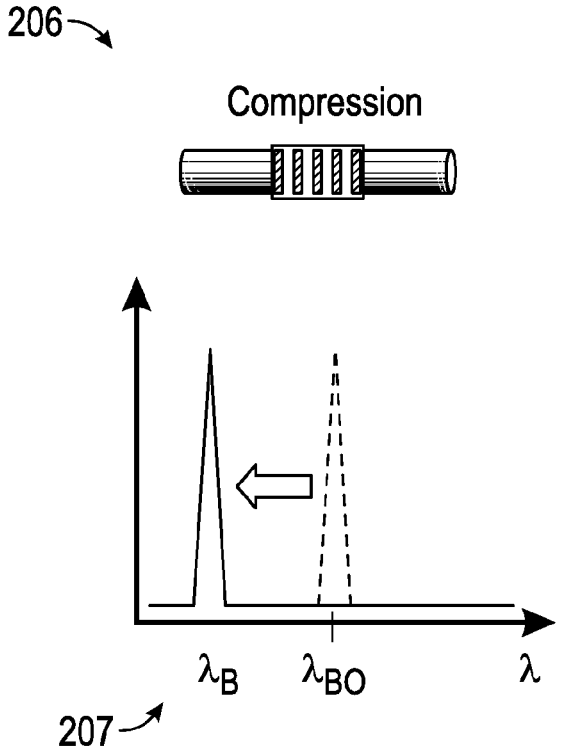

FIG. 2A-2C illustrates operation of an exemplary Fiber Bragg Grating that may be used as a sensor 106 on the exemplary tubular 102 of FIG. 1. A Fiber Bragg Grating is typically a section of the optical fiber 104 in which the refractive index has been altered to have periodic sections of higher and lower refractive index. The distance between the sections of higher refractive index is generally namedas grating period or grating space D. A stress transferred from a sensing target to the sensing fiber will cause a change of the grating space. This change can be measured using either time domain reflectometer (OTDR) or wavelength domain reflectometer (OFDR). A beam of laser light enters the FBG from one end. As the light passes through the FBG, a selected wavelength of light is reflected. The FBG is typically transparent at other wavelengths of light. The wavelength of the reflected light is related to the grating period by the equation $\lambda_B$=2nD, where is the wavelength of the reflected light and is known as the Bragg wavelength, n is an effective refractive index of the grating, and D is the grating period. Using OTDR techniques, this reflected light of specific wavelength shift may be compared to a calibrated light signal to determine the strain value at the FBG.

FIG. 2A shows a typical operation of an FBG 202 that is in a relaxed state experiencing no strain from thermal expansion or contraction, for example. Graph 203 shows reflected optical power peaking at the "relaxed" Bragg wavelength, which may be denoted as $\lambda_{BO}$ to indicate the wavelength of light reflected from the relaxed FBG 202. FIG. 2B shows FBG 204 under thermal expansion wherein the grating period D has increased, thereby increasing the wavelength of the light reflected by the FBG. This is shown as a shift of the reflected wavelength from $\lambda_{B0}$ to higher wavelength $\lambda_B$ in graph 205. FIG. 2C shows FBG 206 under thermal contraction wherein the grating period D has decreased, thereby decreasing the wavelength at which light is reflected by the FBG, as shown in the shift of the reflected wavelength from $\lambda_{BO}$ to lower wavelengths $\lambda_B$ in the graph 207. Since the change in the grating period D is due to a change in temperature, a measured change in wavelength may be used to determine a temperature at the sensor 106.

Returning to FIG. 1, one end of the fiber optic cable 104 is coupled to an interrogation unit 108 typically at a surface location that in one aspect obtains a measurement from each of the sensors 106 to determine a wavelength shift at each of the sensors 106. These wavelength shifts may be indicative of thermal strain resulting from the injection of fluid 138 and thus are indicative of the temperature of the injected fluid. The interrogation unit 108 may transmit a laser light along the fiber optic cable 104 and, in response, receive wavelength shifts associated with the strains at one or more of the sensors 106. In general, the interrogation unit 108 reads the plurality of sensors simultaneously using, for example, frequency divisional multiplexing. The interrogation unit 108 is coupled to a data processing unit 110 and transmits the measured wavelength shifts to the data processing unit 110. The data processing unit 110 receives and processes the measured wavelength shifts from the interrogation unit 108 to determine temperatures at the sensors 106. A typical data processing unit 110 includes a processor 112, at least one storage medium 114 for storing data and results obtained using the exemplary methods disclosed herein, and one or more programs 116 stored in the at least one storage medium 114. The one or more programs 116 are accessible to the processor 112 and enable the processor 112 to perform the various methods disclosed herein. The storage medium 114 may be a non-transitory computer-readable medium. The processor 112 may output results to various devices, such as to a display 118, the storage medium 114, etc.

A fluid injection system is provided to send a fluid 138 downhole for injection into the formation 120. A fluid tank 130 stores the fluid 138 at a surface location. An injection pump 132 pumps the fluid 138 from the fluid tank 130 into the tubular 102. An inline heater 134 imparts heat to the fluid 138 prior to its entry into the tubular 102. The fluid 138 exits the tubular 102 at a downhole location via an opening 140 which may be a sandscreen, a perforated casing, a perforated liner or other suitable opening for dispensing fluid. The sensors 106 may be wrapped around the opening so that the injection fluid 138 comes into contact with the sensors 106 as the fluid exits the tubular 102. The sensors 106 that come into contact with the fluid 138 at the opening 140 are referred to herein as sensors 106*a* in order to distinguish them from sensors that do not come into contact with the fluid 138.

The inline heater 134 may be any heater capable of generating a temperature differential in the fluid 138 that is measurable once the fluid 138 reaches a downhole monitoring zone. The inline heater 134 is controlled by a heat controller 136, which may control the inline heater 134 to increase an amount of heat imparted to the fluid 138 or decrease the amount of heat imparted to the fluid 138. In general, the heat controller 136 will control the inline heater to provide a varying temperature signal to the fluid 138 over time.

When fluid 138 is injected into the tubular 102 at a single temperature, the fluid 138 generally comes into a steady-state equilibrium with the downhole environment when upon exiting the tubular 102. Therefore, a single-temperature fluid is not useful in generating a temperature difference observable at sensors 106*a*. In order to measure a fluid injection profile, the inline heater 134 modulates the temperature of the fluid 138. By imparting the modulated signal H(t), the injection fluid 138 resists coming into thermal equilibrium with the downhole environment until a time after passing the sensors 106*a*. Additionally, the amplitude of the modulation is of a sufficient magnitude to resist thermal equilibrium at the sensors 106*a*. Thus, the sensors 106*a* may measure a signal that is indicative of an injection front of the fluid 138 due to the modulation of the temperature of the fluid 138 and its corresponding amplitude.

Figure 3A:
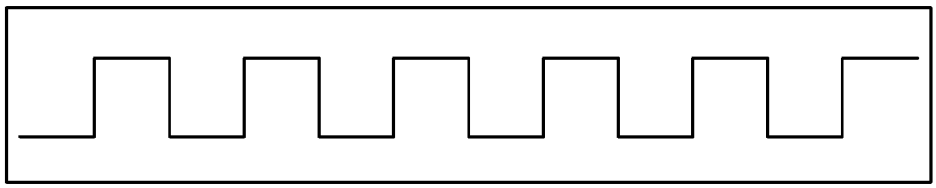
FIGS. 3A and 3B show exemplary temperature profiles that may be imparted onto the fluid at an inline heater of the system of FIG. 1.
Figure 3B:
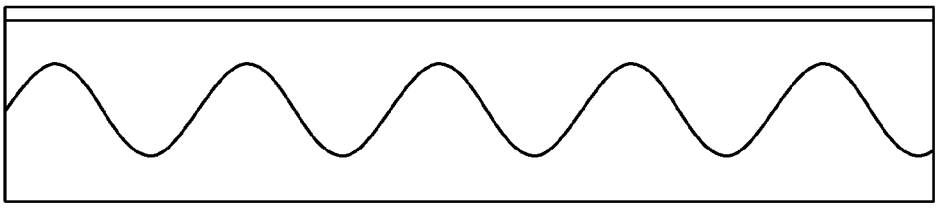

FIGS. 3A and 3B show exemplary temperature profiles H(t) that may be imparted onto the fluid 138 at the inline heater 134. Time is shown along the abscissa and temperature is shown along the ordinate. The temperature profile may be oscillating in time, such as a sinusoidal oscillation shown in FIG. 3A or a square wave shown in FIG. 3B. The modulation of the temperature signal is of sufficient amplitude to produce a detectable temperature difference at the sensors 106. As the fluid flow through the tubular 102, a spatial temperature signal corresponding to H(t) is displayed along the tubular 102.

As the fluid 138 exits the tubular 102 downhole and passes sensors 106*a*, the sensors 106*a* expand or contract based on the temperature of the fluid 138 relative to the temperature of the formation 120. This expansion and contraction is converted into a wavelength shift signal which is read at the interrogator unit 108. The interrogator unit 108 sends the wavelength shift signal to the data processing unit 110 to obtain a two-dimensional temperature profile T(t).

In one embodiment, the obtained temperature signal T(t) of the injection front may be analyzed against the temperature signal H(t) imparted by the inline heater 134 in order to provide information on the real-time flow profile and flow dynamics of the injected fluid 138. The flow profile or other flow parameter may be determined in real-time, i.e., during the course of the fluid injection process, and a parameter of the fluid injection process may be altered in real-time using the determined flow profile or flow parameter.

In various embodiment, monitoring the temperature of the injection fluid 138 over time may allow a user to obtain information on a parameter of the formation. The temperature signal T(t) may be related to a heat conductivity of the formation 120. Also, the temperature signal T(t) may be indicative of a permeability or porosity of the formation, as well as any anisotropies in these parameters. For example, a more porous volume of the formation 120 may receive greater amounts of fluid than a less porous volume of the formation 102. The volume of the formation 120 that receives greater amount of fluid will experience a greater temperature change than a volume of the formation that receives less or no fluid 138. Therefore, anisotropy in the thermally-induced strain signal T(t) may be used to identify such parameters of the formation.

While amplitude of the fluctuating temperature signal H(t) imparted to the fluid may be significant, the amplitude is reduced as the fluid flows through the tubular 102 to its downhole location. Therefore, the amplitude of the temperature fluctuation may be several hundredth of a degree Celsius when the fluid is injected into the formation. Filtering methods may be used to detect these small fluctuations that are generally smaller than the normal resolution of the sensors.

In another embodiment, the temperature signal T(t) may be compared against the temperature signal H(t) to determine a flow rate of the fluid through the tubular 102. A comparison of the signals may determine a time taken for the fluid to flow from the surface location to the downhole location. Knowledge of the pipe dimensions, diameter, etc., may then be used to determine a fluid flow rate through the tubular 102.

Figure 4:
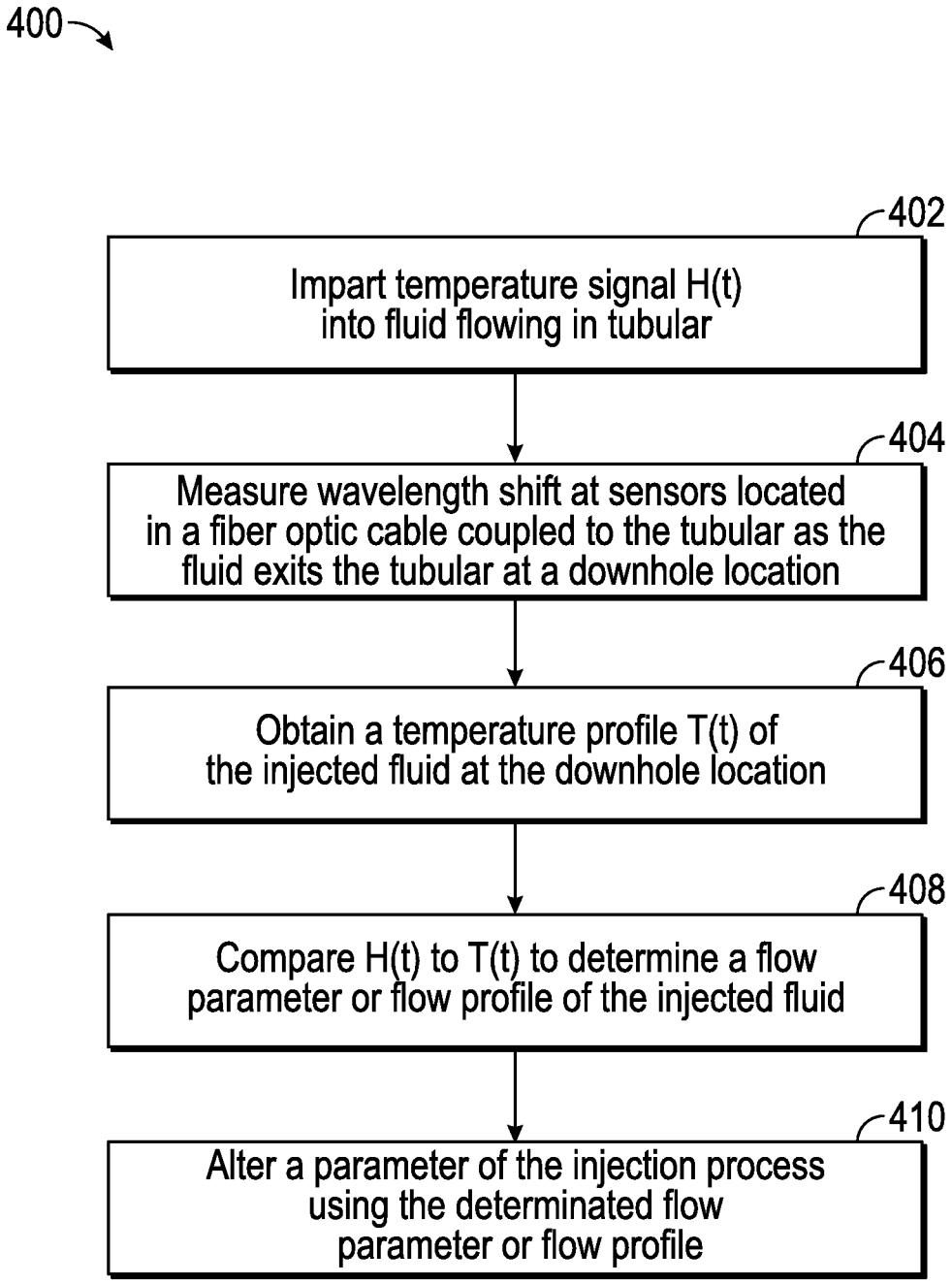
FIG. 4 shows an illustrative flowchart of an exemplary method for determining a flow profile of an injection fluid.

FIG. 4 shows an illustrative flowchart 400 of an exemplary method for determining a flow profile or flow parameter of an injection fluid. In box 402, a temperature signal H(t) is imparted to the fluid. The temperature signal may be imparted just prior to the fluid entering a tubular or at a selected location in the tubular. In box 404, the fluid exits the tubular downhole and a wavelength shift is measured at sensors 106*a* as the fluid passes the sensors 106*a*. In box 406, the wavelength shifts are used to determine a temperature profile T(t) of the injected fluid as the fluid exits the tubular. In box 408, the temperature profile T(t) is compared to the imparted temperature signal H(t) to determine an injection profile of flow parameter of the fluid upon exiting the tubular. The injection profile may be a two-dimensional profile, in various embodiments. In box 410, the determined flow parameter or flow profile may be used to alter a parameter of the injection process.

Therefore, in one aspect the present disclosure provides a method of monitoring a fluid injection at a downhole location in a wellbore, the method including: providing a member in the wellbore, the member including a passage for flow of fluid and a fiber optic cable including a plurality of temperature sensors wrapped around the member; imparting a selected temperature signal into the fluid flowing in the member; measuring a temperature of the fluid exiting the member at the downhole location using the plurality of temperature sensors; and comparing the measured temperature to the imparted thermal signal to determine a flow parameter of the injected fluid. The imparted temperature signal may be a spatio-temporal temperature signal. The flow parameter of the injected fluid may include a two-dimensional flow profile of the fluid be injected into the formation. The flow parameter may be determined in real-time and used in real-time to alter a parameter of the injection process. The plurality of temperature sensors may include a plurality of Fiber-Bragg gratings formed in the fiber optic cable, and the temperature measurement is thus related to a thermally-induced strain in least one of the plurality of Fiber-Bragg gratings. The injected fluid may be a fluid for fracturing the formation, acid stimulation, or flooding an oil/gas well, for example. Modulation of the imparted temperature signal disturbs the occurrence of thermal equilibrium between the injected fluid and its immediate downhole environment at the plurality of temperature sensors.

In another aspect, the present disclosure provides a system for monitoring a fluid injection in a wellbore, the system including: a member in the wellbore configured to provide a flow path for the fluid from a surface location to an injection location in the wellbore; a heating element configured to impart a temperature signal into the fluid flowing in the member; a fiber optic cable including a plurality of spaced-apart temperature sensors wrapped around the member to obtain temperature measurements of the injected fluid exiting the member at a downhole location; and a processor configured to compare the imparted temperature signal and downhole temperature measurements to determine a flow parameter of the injected fluid. The heating element may generate a spatio-temporal temperature signal. The determined flow parameter of the injected fluid further may be a two-dimensional flow profile of the injected fluid. The processor may further determine the flow parameter in real-time and alter a parameter of the injection in real-time using the determined flow parameter. The plurality of temperature sensors may be a plurality of Fiber-Bragg gratings formed in the fiber optic cable, and the temperature measurement may be related to a thermally-induced strain in at least one of the plurality of Fiber-Bragg gratings. The fluid may include a fracturing fluid, and acid for stimulating the formation, etc. The heating element may impart the temperature signal with an amplitude of sufficient height to disturb an occurrence of thermal equilibrium between a temperature of the injected fluid and a temperature of the downhole location at the plurality of sensors.

In another aspect, the present disclosure provides a non-transitory computer-readable medium having a set of instructions stored therein that when accessed by a processor enables the processor to perform a method of monitoring a fluid injection at a downhole location, the method including: imparting a selected temperature signal into the fluid flowing in a member in the wellbore from a surface location to a downhole injection location; measuring a temperature of the fluid exiting the member at the downhole location using a plurality of temperature sensors wrapped around the member at the downhole injection location; and comparing the measured temperature to the imparted temperature signal to determine a flow parameter of the injected fluid. The imparted temperature signal may be a spatio-temporal temperature signal. The flow parameter may be a two-dimensional flow profile of the injected fluid. The flow parameter may be determined in real-time, and a parameter of the injection process may be altered in real-time using the determined flow parameter. The plurality of temperature sensors may include a plurality of Fiber-Bragg gratings formed in a fiber optic cable, and the temperature measurement may be related to a thermally-induced strain in least one of the plurality of Fiber-Bragg gratings. An amplitude of the imparted temperature signal may be selected to disturb an occurrence of thermal equilibrium between a temperature of the injected fluid and a temperature of the downhole location at the plurality of sensors.

While the foregoing disclosure is directed to the preferred embodiments of the disclosure, various modifications will be apparent to those skilled in the art. It is intended that all variations within the scope and spirit of the appended claims be embraced by the foregoing disclosure.

What is claimed is:

1. A method of monitoring a fluid injection at a downhole location in a wellbore, comprising:

providing a member in the wellbore, the member including a passage for flow of fluid and a fiber optic cable including a plurality of temperature sensors wrapped around the member;

imparting a selected temperature signal into the fluid flowing in the member via a heating element at an entrance of the passage;

measuring a temperature of the fluid exiting the member at the downhole location using the plurality of temperature sensors at an exit of the passage; and comparing the measured temperature to the imparted temperature signal to determine a flow parameter of the injected fluid.

2. The method of claim 1, wherein the imparted temperature signal includes a spatial temperature signal.

3. The method of claim 1, wherein the flow parameter of the injected fluid further includes a two-dimensional flow profile of the injected fluid into the formation.

4. The method of claim 1, further comprising determining the flow parameter in real-time and altering a parameter of the injection using the determined flow parameter.

5. The method of claim 1, wherein the plurality of temperature sensors further comprises a plurality of Fiber-Bragg gratings formed in the fiber optic cable and the temperature measurement is related to a thermally-induced strain in least one of the plurality of Fiber-Bragg gratings.

6. The method of claim 1, wherein the fluid comprises a fluid for fracturing the formation.

7. The method of claim 1, wherein a modulation of the imparted temperature signal disturbs an equilibrium between a temperature of the injected fluid and a temperature of the downhole location at the plurality of temperature sensors.

8. A system for monitoring a fluid injection in a wellbore, comprising:

a member in the wellbore configured to provide a flow path for the fluid from a surface location to an injection location in the wellbore;

a heating element located at an entrance to the member at a surface location configured to impart a temperature signal into the fluid flowing in the member;

a fiber optic cable including a plurality of spaced-apart temperature sensors wrapped around the member to obtain temperature measurements of the injected fluid exiting the member at a downhole location; and a processor configured to compare the imparted temperature signal and downhole temperature measurements to determine a flow parameter of the injected fluid.

9. The system of claim 8, wherein heating element is configured to generate a spatial temperature signal.

10. The system of claim 8, wherein the determined flow parameter of the injected fluid further includes a two-dimensional flow profile of the injected fluid into the formation.

11. The system of claim 8, wherein the processor is further configured to determine the flow parameter in real-time and alter a parameter of the injection using the determined flow parameter.

12. The system of claim 8, wherein the plurality of temperature sensors further comprises a plurality of Fiber-Bragg gratings formed in the fiber optic cable and the temperature measurement is related to a thermally-induced strain in at least one of the plurality of Fiber-Bragg gratings.

13. The system of claim 8, wherein the fluid comprises a fluid for fracturing the formation.

14. The system of claim 8, wherein the heating element is further configured to impart the temperature signal with an amplitude that disturbs an equilibrium between a temperature of the injected fluid and a temperature of the downhole location at the plurality of sensors.

15. A non-transitory computer-readable medium having a set of instructions stored therein that when accessed by a processor enables the processor to perform a method of monitoring a fluid injection at a downhole location, the method comprising:

imparting a selected temperature signal into the fluid entering a member in the wellbore at a surface location via a heating element at the surface location, wherein the fluid flows in the member from the surface location to a downhole injection location;

measuring a temperature of the fluid exiting the member at the downhole location using a plurality of temperature sensors wrapped around the member at the downhole injection location; and comparing the measured temperature to the imparted temperature signal to determine a flow parameter of the injected fluid.

16. The computer-readable medium of claim 15, wherein the imparted temperature signal includes a spatial temperature signal.

17. The computer-readable medium of claim 15, wherein the flow parameter of the injected fluid further includes a two-dimensional flow profile of the injected fluid into the formation.

18. The computer-readable medium of claim 15, the method further comprising determining the flow parameter in real-time and altering a parameter of the injection using the determined flow parameter.

19. The computer-readable medium of claim 15, wherein the plurality of temperature sensors further comprises a plurality of Fiber-Bragg gratings formed in a fiber optic cable and the temperature measurement is related to a thermally-induced strain in least one of the plurality of Fiber-Bragg gratings.

20. The computer-readable medium of claim 15, wherein an amplitude of the imparted temperature signal is selected to disturbs an occurrence of thermal equilibrium between a temperature of the injected fluid and a temperature of the downhole location at the plurality of sensors.

* * * * *